United States Patent [19]

Struck et al.

[11] 4,348,258

[45] * Sep. 7, 1982

[54] SPRAY NOZZLE FOR COKE OVEN GAS-COLLECTING SYSTEM

[75] Inventors: Carl-Heinz Struck, Bochum; Ralf Schumacher, Hagen, both of Fed. Rep. of Germany

[73] Assignee: Dr. C. Otto & Comp. G.m.b.H., Bochum, Fed. Rep. of Germany

[ * ] Notice: The portion of the term of this patent subsequent to Nov. 10, 1998, has been disclaimed.

[21] Appl. No.: 174,451

[22] Filed: Aug. 1, 1980

[30] Foreign Application Priority Data

Sep. 15, 1979 [DE] Fed. Rep. of Germany ..... 2937409

[51] Int. Cl.[3] ..... C10B 27/04; C10B 27/06; C10B 41/08

[52] U.S. Cl. ..... 202/255; 202/261; 202/263

[58] Field of Search ..... 239/558, 559, 589; 202/254–261, 263; 261/116, 118

[56] References Cited

U.S. PATENT DOCUMENTS

| | | | |
|---|---|---|---|
| 1,151,259 | 8/1915 | Fischer | 261/116 |
| 1,846,493 | 2/1932 | Kahr | 239/558 |
| 1,982,538 | 11/1934 | Reedy | 239/559 X |
| 2,082,118 | 6/1937 | Potter | 202/258 |
| 2,603,232 | 7/1952 | Keammerer | 202/258 X |
| 3,092,333 | 6/1963 | Gaiotto | 239/558 X |
| 3,309,286 | 3/1967 | Alderman | 202/258 |
| 4,168,208 | 9/1979 | Althoff et al. | 202/254 |

*Primary Examiner*—Bradley Garris

*Attorney, Agent, or Firm*—Thomas H. Murray

[57] ABSTRACT

A spray nozzle for use in the elbow interconnecting a coke oven ascension pipe and a main, characterized in having frusto-conical nozzle orifices to generate sprays which commpletely cover the elbow cross section only when they reach the transition between the elbow and the coke oven main. The invention resides in the realization that in order to optimize the performance of the nozzle, there must be a specified relationship between the inlet diameters of the frusto-conical orifices, the outlet diameters of the orifices and the radial and circumferential distances between the centers of orifices arranged in concentric circles.

6 Claims, 5 Drawing Figures

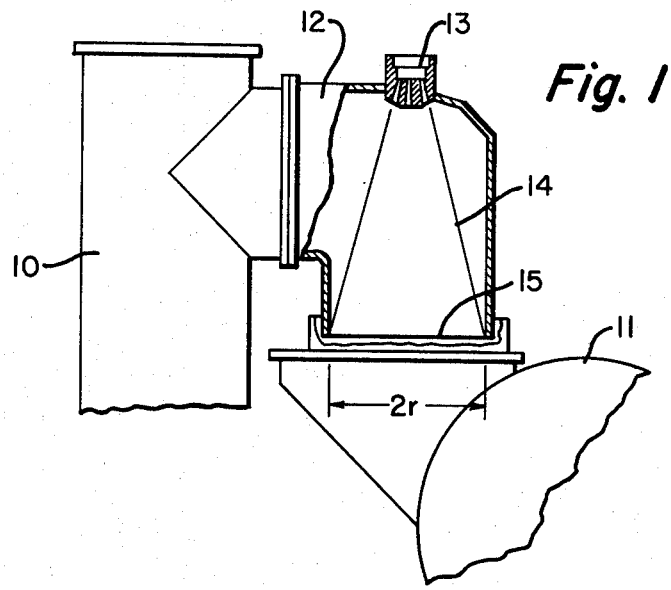
Fig. 1
Fig. 2
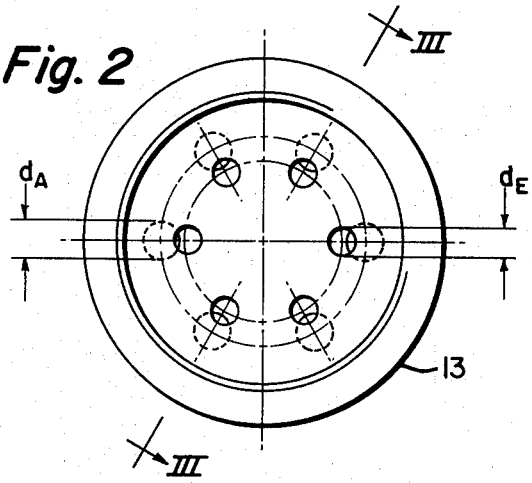
Fig. 3
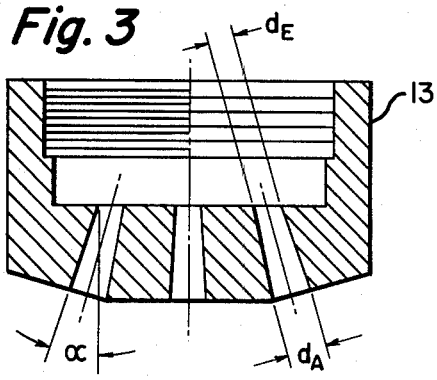
Fig. 4
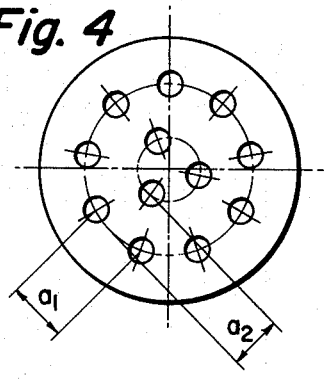
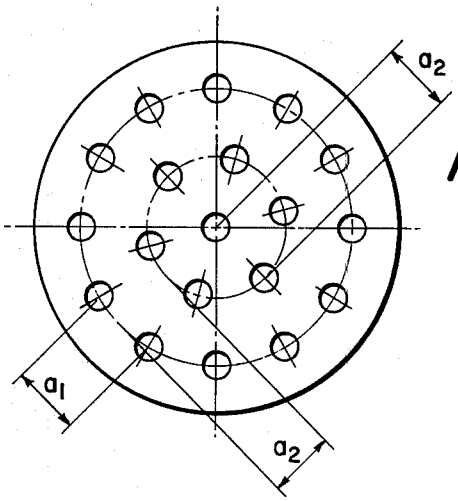
Fig. 5

SPRAY NOZZLE FOR COKE OVEN GAS-COLLECTING SYSTEM

BACKGROUND OF THE INVENTION

As is known, a coke oven gas-collecting system includes an ascension pipe, leading from a coking chamber, which is connected through an elbow to the gas main for the coke oven installation. A nozzle projects through the top wall of the elbow and is used not only during operation of the ovens for the introduction of an ammonia-containing liquid but also to extract, with the use of high-pressure steam, the gases evolved during charging which pass upwardly through the top gas-collecting chamber and the ascension pipe into the main.

It is important that all gases which evolve during charging of the oven chamber be collected completely such that they do not escape into the atmosphere. For this reason, it is necessary to produce a very strong suction in the elbow leading to the main by means of the steam passing through the aforesaid nozzle.

SUMMARY OF THE INVENTION

In accordance with the present invention, a new and improved nozzle construction is provided for coke oven elbow sections which is simple to manufacture but which, at the same time, facilitates the extraction of very considerable quantities of gas during charging of a coke oven chamber. The orifices extending through the nozzle are frusto-conical in shape and are arranged in one or more circles uniformly distributed around a central orifice, or around a group of orifices. All orifices in the nozzle except the central orifice are inclined outwardly from the axis of the nozzle such that the injected propellent (e.g., steam) issues from the nozzle in the form of a conical group of streams. A nozzle of this type is shown, for example, in U.S. Pat. No. 4,299,356, issued Nov. 10, 1981. However, the nozzle shown in that patent is intended for use with liquids only.

In order to achieve optimal operating conditions, the dimensions of the orifices and their spacing in concentric circles are critical. In this regard, the ratio of the circumferential distance between the centers of orifices in any circle to the exit diameter of each orifice must fall within predetermined limits. Likewise, the ratio of the radial distance between the centers of orifices in two concentric circles, or the distance between the axis of a central orifice and a first circle of surrounding orifices, to the exit diameter of each orifice must likewise fall within predetermined limits. Finally, there must be a specified relationship between the square of the diameter of the entry end of each orifice to the square of the diameter of the exit end of each orifice.

The above and other objects and features of the invention will become apparent from the following detailed description taken in connection with the accompanying drawings which form a part of the specification, and in which:

FIG. 1 is a broken-away elevational view showing the multi-orificed nozzle of the invention positioned within an elbow which connects the ascension pipe and main of a regenerative coke oven;

FIG. 2 is a bottom or plan view of a nozzle constructed in accordance with the invention;

FIG. 3 is a cross-sectional view taken substantially along line III—III of FIG. 2;

FIG. 4 is a bottom view of a nozzle constructed in accordance with the invention having two concentric rows of orifices therein; and FIG. 5 is a bottom view of still another embodiment of the invention wherein two concentric rings of orifices extend around a single, central orifice.

With reference now to the drawings, and particularly to FIG. 1, there is shown a conventional ascension pipe 10 for a regenerative coken oven installation connected to a coke oven main 11 through an elbow 12. The multi-orificed nozzle of the invention is identified by the reference numeral 13 and projects through the top wall of the elbow 10. Steam, for example, issues from the nozzle 13 in a cone-shaped configuration 14 which fills the entire cross section of the elbow only at the junction or transition opening 15 between the elbow and the main oven.

As shown in FIGS. 2 and 3, the nozzle 13 is generally cup-shaped and has a cylindrical side wall and a bottom wall through which generally frusto-conical nozzles 15 extend. The orifices have a diameter $d_E$ on the entry side and a larger diameter $d_A$ on the exit side.

The shape of the spray configuration 14 shown in FIG. 1 is determined by the inclination of the outer circle of nozzle orifices. As can be seen in FIG. 3, the axes of the orifices in the outer circle or ring of orifices extend along the sides of a cone having an apex angle $2\alpha$. If r denotes the radius of the bottom of the cone-shaped configuration 14 and L denotes the distance between the apex of the cone-shaped configuration 14 and is its lower maximum diameter end (i.e., at the transition opening 15 between the elbow 12 and the main 11), then:

$$\tan \alpha = r/L$$

Experiments have shown that the gas extracted from the coke oven compresses and, therefore, stretches the conical group of streams issuing from the nozzle 13. As a result, the angle $\alpha$ must be increased if the space above the opening between the elbow 12 and main 11 is to be entirely occupied by the configuration 14. In this regard, extraction is optimal over a wide range of steam pressures if in choosing the angle $\alpha$ for the cone-shaped configuration, 0.9 L is used instead of L.

In FIG. 4, an outer circle of nine orifices is disposed around the inner circle of three orifices. The distance between orifice-centers in the respective circles is designated $a_2$; while the circumferential distance between centers in the outer circle is designated $a_1$. In FIG. 5, there are two groups of orifices arranged in circles about a central orifice 17. Six orifices are disposed in the inner circle and twelve orifices are disposed in the outer circle. The radial distance between the centers of orifices in concentric circles is again designated as $a_2$. This same dimension exists between the central orifice 17 and the first circle of orifices.

For optimal results, the distance $a_1$ between the centers of the orifices in any circle to the diameter $d_A$ of the exit end of each orifice is from 1.5 to 2.5 and preferably 1.8 to 2.2. Furthermore, the ratio of the radial distance $a_2$ to the diameter $d_A$ of the exit end of each orifice is from 1.3 to 2.2 and preferably 1.8. Finally, the ratio of the square of the diameter $d_E$ of the entry end of each orifice to the square of the diameter $d_A$ of the exit end of each orifice is between 0.25 and 0.65 and preferably between 0.35 and 0.50. By following these parameters, the cone-shaped configuration 14 will fill the elbow 12 only at its transition 15 to the gas main 11 and an effective vacuum will be produced within the ascension pipe 10 to pull the gases evolved during charging of a coke oven chamber.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In combination with a coke oven a multi-orificed nozzle adapted to be fitted into the elbow interconnecting the ascension pipe and main of a coke oven, comprising a generally cup-shaped element having a cylindrical side wall and a bottom wall, nozzle orifices in said bottom wall, said orifices being frusto-conical in configuration and inclined outwardly with respect to the axis of the nozzle, the orifices being wider at their exit ends than at their entrance ends and being disposed in at least one circle around the axis of the nozzle with the ratio of the circumferential distance between orifices in the circle to the diameter of the exit ends of the orifices being from 1.5 to 2.5, and means for directing steam through the orifices in said nozzle.

2. The nozzle of claim 1 wherein said ratio is 1.8 to 2.2.

3. The nozzle of claim 1 having two concentric circles of orifices formed therein with the ratio of the radial distance between the centers of orifices in adjacent circles to the diameter of the ext ends of the orifices being from 1.3 to 2.2.

4. The nozzle of claim 3 wherein said radial ratio is 1.8.

5. The nozzle of claim 1 wherein the ratio of the square of the diameter of the entry end of each orifice to the square of the diameter of the exit end of each orifice is between 0.25 and 0.65.

6. The nozzle of claim 5 wherein said square ratio is between 0.35 and 0.50.

* * * * *